US007819354B2

(12) United States Patent
Robitaille et al.

(10) Patent No.: US 7,819,354 B2
(45) Date of Patent: Oct. 26, 2010

(54) ROLL HOLDER FOR TAPE DISPENSER AND TAPE DISPENSER ASSEMBLY THEREWITH

(75) Inventors: Martin Robitaille, 4765, rue St-Félix, St-Augustin-de-Desmaures, Qc (CA) G3A 2Y2; Steve Gagnon, L'Ange Gardien (CA)

(73) Assignee: Martin Robitaille, St-Augustin-de-Desmaures ( * ) Notice: Subject to any disclaimer, the term of this patent is extended or adjusted under 35 U.S.C. 154(b) by 202 days.

(21) Appl. No.: 12/166,947

(22) Filed: Jul. 2, 2008

(65) Prior Publication Data

US 2010/0000686 A1 Jan. 7, 2010

(51) Int. Cl.

| | |
|---|---|
| ***B65H 23/00*** | (2006.01) |
| ***B65H 23/04*** | (2006.01) |
| ***B65H 23/08*** | (2006.01) |
| ***B65H 23/14*** | (2006.01) |

(52) U.S. Cl. ..... 242/410; 156/494; 156/495; 206/389; 206/391; 206/411; 206/413; 206/415; 414/431; 414/432

(58) Field of Classification Search ..... 156/459; 206/389, 391–394, 407, 411, 413–416; 414/431, 414/432, 911; 242/410–423.2
See application file for complete search history.

(56) References Cited

U.S. PATENT DOCUMENTS

| | | | | |
|---|---|---|---|---|
| 3,327,846 | A | 6/1967 | Offray, Jr. | |
| 3,865,326 | A * | 2/1975 | Beaudoin | 242/613.5 |
| 4,102,513 | A * | 7/1978 | Guard | 242/423.1 |
| 4,372,472 | A | 2/1983 | Herrmann | |
| 4,408,913 | A | 10/1983 | Frechette | |
| 4,453,634 | A | 6/1984 | Blumenthal | |
| 4,477,037 | A * | 10/1984 | Goldstein | 242/423.2 |
| 4,676,446 | A | 6/1987 | Ciocarelli et al. | |
| 4,706,442 | A * | 11/1987 | Riemenschneider | 53/556 |
| 4,752,047 | A | 6/1988 | Franks | |
| 4,917,327 | A | 4/1990 | Asbury, Jr. et al. | |
| 4,944,472 | A | 7/1990 | Stahl | |
| 4,998,655 | A | 3/1991 | Huang | |
| 5,029,768 | A | 7/1991 | Asbury, Jr. et al. | |
| 5,071,051 | A | 12/1991 | Corbo et al. | |
| 5,193,680 | A | 3/1993 | Schumann et al. | |
| 5,228,821 | A | 7/1993 | Gleffe | |
| 5,692,625 | A | 12/1997 | Filipescu et al. | |

(Continued)

FOREIGN PATENT DOCUMENTS

| | | |
|---|---|---|
| GB | 1442261 | 7/1976 |

(Continued)

*Primary Examiner*—Khanh Nguyen
*Assistant Examiner*—Carson Gross
(74) *Attorney, Agent, or Firm*—Brouillette & Partners; Robert Brouillette; Francois Cartier

(57) ABSTRACT

The present invention discloses a roll holder for tape dispenser and a tape dispenser assembly therewith. The roll holder comprises a cylindrical body and an annular portion made from a material having a high friction coefficient, the annular portion being fixed inside the cylindrical body. The roll holder tape dispenser is supported by a shaft. Two cylindrical bodies are connected to a roll of tape, one at each extremity of the tape spool by press-fitting. The shaft passes through the annular portion and the friction occurring between the shaft and annular portion induce a tension in the tape when the tape is unwound from the roll.

30 Claims, 6 Drawing Sheets

U.S. PATENT DOCUMENTS

| | | | | |
|---|---|---|---|---|
| 5,755,397 | A | 5/1998 | Freese | |
| 5,775,629 | A | 7/1998 | Cyr | |
| 6,325,324 | B1 | 12/2001 | Getz et al. | |
| 2005/0242225 | A1* | 11/2005 | Robitaille et al. | 242/422 |

FOREIGN PATENT DOCUMENTS

| | | |
|---|---|---|
| GB | 2226338 A | 6/1990 |
| GB | 2277509 A | 2/1994 |

* cited by examiner

ROLL HOLDER FOR TAPE DISPENSER AND TAPE DISPENSER ASSEMBLY THEREWITH

CROSS-REFERENCE TO RELATED APPLICATIONS

There are no cross related applications.

FIELD OF THE INVENTION

The present invention generally relates to apparatuses and devices for dispensing tape or other similar products such as, but not limited to, ribbon, string or web. More particularly, the present invention relates to such apparatuses and devices which comprise tensioning mechanisms to control the dispensing of the tape.

BACKGROUND OF THE INVENTION

Reinforcing or tear tapes have been used for many years in modern packaging as an aid to maintain structural integrity or as an easy open feature in boxes, packages and/or containers. The commercially available tape dispensers used at corrugating or laminating machine have an important limitation. All spools or rolls are supplied in individually packaged boxes, where each roll has to be unpacked, lifted and installed on a tape dispenser machine located near the corrugating or laminating machine. Since each roll has to be manually lifted and manipulated by the operators of the laminating or corrugating machine, each roll cannot weight more than 35 pounds to limit the dangers of injuries to the operators. This fact brings another important drawback. With a spool or roll weight this small, only a very limited amount of linear footage of tape can be wound on these rolls. With the laminating or corrugating machines going faster over the years, an important need for splicing these rolls arose, since these processes cannot be stopped as they need to have a constant supply of tape. In this industry the footage of these tape rolls are usually between 10,000 and 30,000 feet. Since multiple tapes are used in these packaging making processes, we often see a splicing rate for tape roll of 1 roll every 5 to 8 minutes. This means that an operator has to unpack a roll, lift it, install it on the dispenser and prepare the splicing mechanism every 5 to 8 minutes. This procedure can be very time consuming.

The literature is abundant with such tape dispensers and splicing systems, and they all have in common the limitation to roll size and weight and the necessity for the operator to manually handle these rolls. In more details, we can see U.S. Pat. No. 4,917,327 and U.S. Pat. No. 5,029,768 where we clearly see the general parameters of the tape dispenser and the need for tension control and a splicing mechanism. In U.S. Pat. No. 5,775,629 and U.S. Pat. No. 6,325,324 we also see different splicing techniques that can be used on tape dispensers.

The use of a package that dispenses tape exists in other applications than the corrugated board reinforcement or easy open feature for containers. For example, in the pressure sensitive adhesive packaging tape we can see many patents on this subject: U.S. Pat. No. 4,372,472; U.S. Pat. No. 4,453,634; U.S. Pat. No. 4,676,446; U.S. Pat. No. 4,998,655 and U.S. Pat. No. 5,071,051 are all patents on this subject. But all these patents, even if they cover the concept of package and dispenser, are all related to handheld dispenser of small rolls of pressure sensitive packaging tape and none use the concept of packaging/dispenser for the purpose of reducing roll manipulations and thus the increasing of tape roll footage.

Transport and packaging assemblies have also been proposed in the past. U.S. Pat. No. 5,228,821; U.S. Pat. No. 5,692,625 for example, disclosed folding racks for the storing and dispensing of rolled material. However, these systems are not design for high speed dispensing and they do not include tensioning device to generate tension in the unwound material. Also, these systems are limited to one or two rolls, a feature which may not be desirable when multiple rolls are needed simultaneously.

OBJECTS OF THE INVENTION

A first object of the present invention is to provide a tape dispenser/package that can be used both as a transport package for the rolls and as dispenser of the same rolls.

Another object of the present invention is to provide a tape dispenser/package that requires less human manipulation.

Yet another object of the present invention is to provide a tape dispenser/package that can hold multiple spools of tape which can be unwound simultaneously.

A further object of the present invention is to provide a tape dispenser/package that can be easily displaced around warehouse, factory and the like.

Yet another object of the present invention is to provide a tape dispenser/package that can be mounted on standard wooden or plastic pallet.

Another object of the present invention is to provide a tape dispenser/package that is cheap to manufacture.

Other and further objects and advantages of the present invention will be obvious upon an understanding of the illustrative embodiments about to be described or will be indicated in the appended claims, and various advantages not referred to herein will occur to one skilled in the art upon employment of the invention in practice.

SUMMARY OF THE INVENTION

The aforesaid and other objectives of the present invention are realized by generally providing a roll holder for the dispensing of tape or the like, the roll holder providing tension in the tape when the tape is dispensed, the rolls of tape comprising a core on which the tape is rolled, the core being supported by a shaft, the roll holder comprising a cylindrical hollow body comprising a first portion and a second portion, the first portion being inserted in the core and an annular portion, the annular portion being connected inside the cylindrical hollow body, the annular portion having an inner diameter larger than the outer diameter of the shaft; and wherein said the passes through the annular portion.

In another embodiment, the aforesaid and other objectives of the present invention are realized by generally providing a dispenser assembly for rolls of tape or the like, the roll of tape adapted to be mounted of a shaft, the dispenser assembly comprising at least one roll of tape or the like, the roll of tape comprising a core on which tape is wound, at least one pair of roll holder, the roll holder comprising; a cylindrical hollow body comprising a first portion and a second portion, the first portion being inserted in the core; an annular portion, the annular portion being connected inside the cylindrical hollow body, the annular portion having an inner diameter larger than the outer diameter of the shaft; and wherein the shaft passes through the annular portion and wherein each end of the core is receiving the roll holder.

The roll holders of the present invention are typically provided in pair for a tape roll, each holder of the pair being adapted to be respectively inserted in each end of the hollow core of the roll of tape around which the tape is wound.

In accordance with the present invention, the roll holder typically comprises a substantially cylindrical hollow outer body and a substantially annular portion adapted to be mounted inside the cylindrical body.

More particularly, the cylindrical body typically comprises a first portion adapted to be inserted into the hollow core of the roll of tape and a second portion, extending from the first portion outside the hollow core of the roll of tape. The first and second portions are typically separated by a blind stop on which the extremity of the hollow core abuts when the holder is inserted into the hollow core.

The outer surface of the first portion preferably comprises one or more tongues extending preferably in parallel to the axis of the holder. The tongues are typically configured to frictionally engage (press-fitting) the inner surface of the hollow core to provide a secure engagement between the holder and the roll. The free extremity of the first portion is preferably tapered such as to ease the insertion of the holder into the hollow core.

The outer surface of the second portion is typically smooth and is preferably adapted to be engaged by the gripping tool of a hoist.

The annular portion is secured inside the cylindrical body. The annular portion defines a passage through which can extend the support shaft onto which is mounted the roll of tape. In accordance with the present invention, the material and dimensions of the annular portion are chosen such as to generate a predetermined amount of friction with the shaft as the tape is unwound from the roll. The amount of friction may be adapted by varying the length of the annular (thus changing the dimensions of the contact surface between the shaft and the annular portion) and the material of the annular portion.

The internal diameter of the annular portion is larger than the external diameter of the shaft supporting the tape roll. The gap between them allows the tape roll to rotate when the tape is pulled from the roll. The shaft is partially in contact with the annular portion of the roll holder.

In a further embodiment, the first portion of the generally cylindrical body is conical. The cylindrical body is similarly inserted in the core of the tape of roll, the outer surface of the first portion contacting the core. In this embodiment, a blind stop could also be used.

In use, a roll holder in inserted into each end of the hollow core of the roll of tape and the roll of tape is then slid along a fixed supporting shaft. The tape of the roll of tape can then be unwound. In accordance with the present invention, as the tape is unwound, the weight of the roll forces the annular portion located inside the roll holder against the fixed shaft, thereby generating dynamic frictional force which slows down the unwinding roll and tensions the dispensed tape. As the tape is unwound, the weight of the roll diminishes and the dynamic frictional force between the bushing and the shaft is correspondingly reduced. The reduced frictional force allows the roll tape to be unwound faster, which is necessary since the diameter of the roll has diminished.

It is to be understood the roll holder of the present invention is not limited to be used with tape only; the roll holder may be used with almost any elongated product that is dispensed through a spool rotating on a shaft.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel roll holder for tape dispenser and a tape dispenser assembly therewith will be described hereinafter. Although the invention is described in terms of specific illustrative embodiments, it is to be understood that the embodiments described herein are by way of example only and that the scope of the invention is not intended to be limited thereby.

Figure 1:
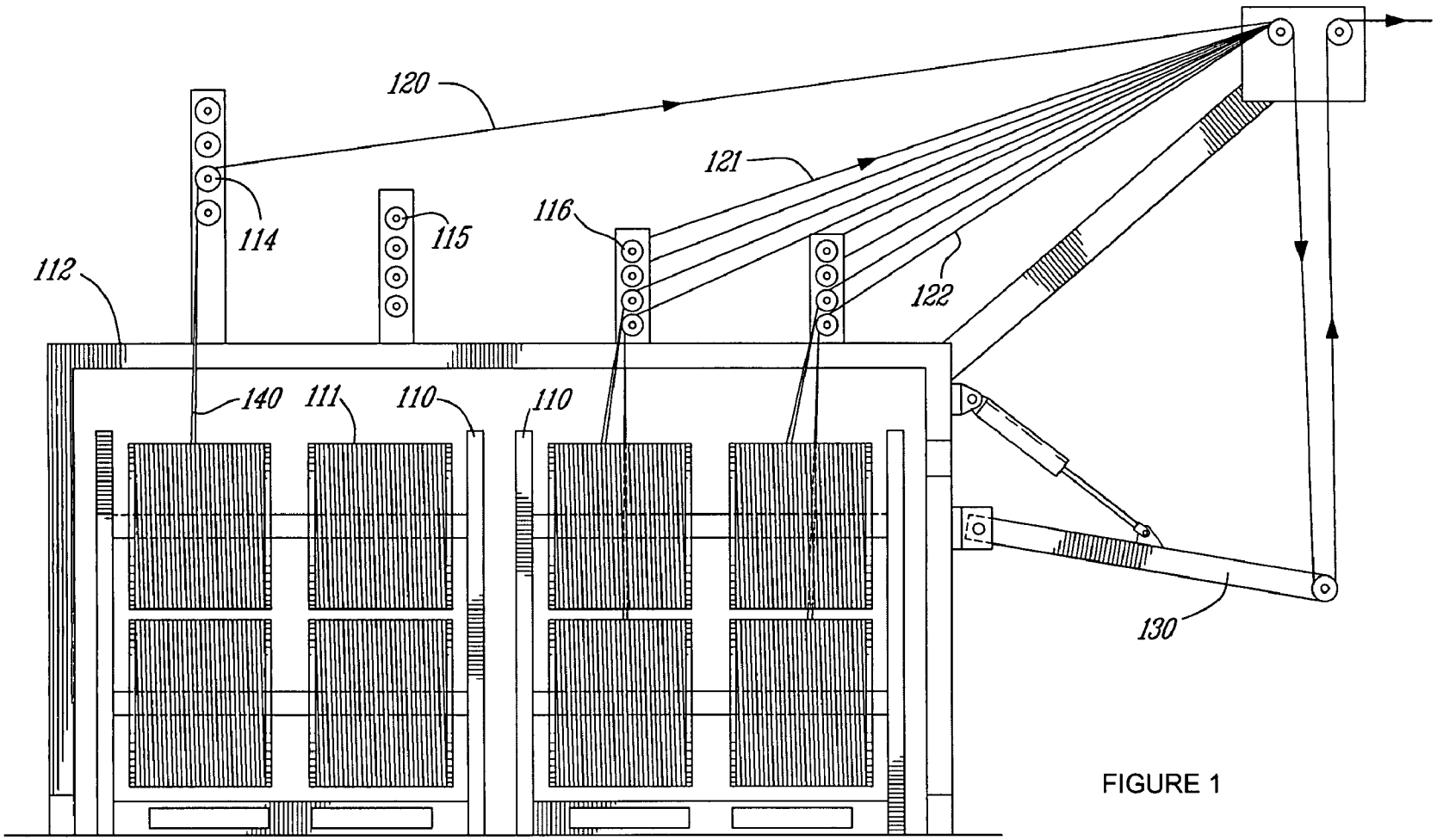
FIG. 1 is a front view of two tape dispenser assemblies with the frame rack over them providing the multiple tape paths.

The embodiment of FIG. 1 shows an embodiment of the tape dispenser for the dispensing of a ribbon at a corrugating machine or press (not shown). The tape dispenser assemblies 110 are enclosed in a frame rack 112 supporting guide rollers 114, 115, 116 to provide multiple tape paths 120, 121, 122 coming off the tape dispenser assembly up towards the splicer unit 30 and the corrugating machine or press. The tape 140 is pulled out from the tape dispenser assembly 110 and feed to the guide rollers 114, 115, 116 and the splicer unit 130. The tape roll 111 is inside the tape dispenser assembly 110 and the tape 140 can be unwound directly from the tape roll 111 without removing it from the tape dispenser assembly 10. Different splicing systems can be used in the splicer unit 130 of the frame rack 112 to splice on tape roll 111 to the next. Different tape paths 120, 121, 122 are provided to permit the splicing of any tape roll 111 with any other tape roll in the tape dispenser 110 or another tape dispenser positioned next to it.

Figure 2:
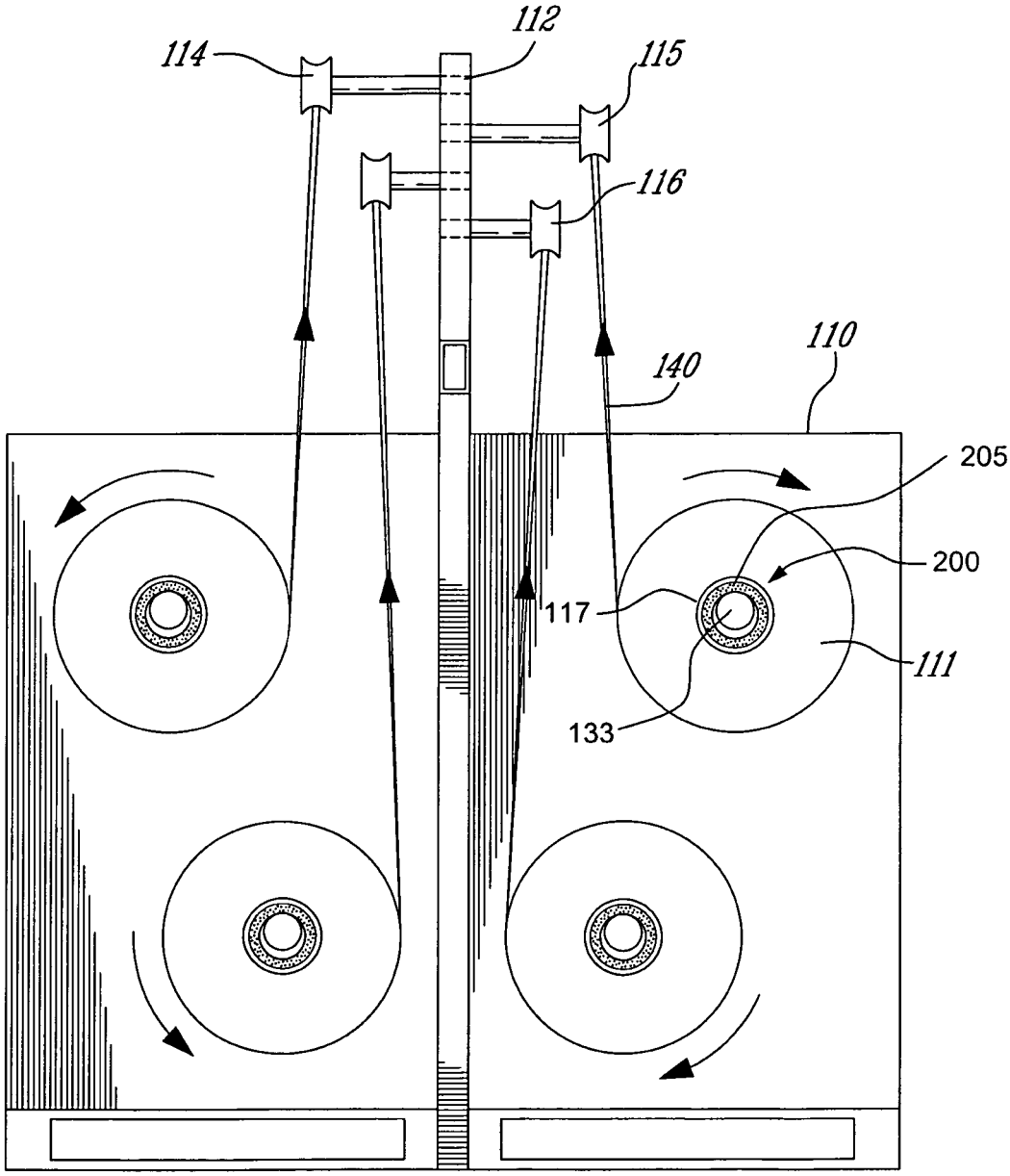
FIG. 2 is a side view of the tape dispenser assembly shown in FIG. 1 showing parts of the frame rack.

As illustrated in FIG. 2, to provide adequate tensioning of the tape 140 from start to end of the tape roll 111, a tensioning device, the roll holder 200, is used to create friction between the shaft 133 and the annular portion 205. The roll holder 200 is inserted inside the core 117 of the tape roll 111 and is disposed on the shaft 133. The shaft 133 passes through the opening in the annular portion 205. More details are provided for the roll holder in FIG. 5.

Figure 3:
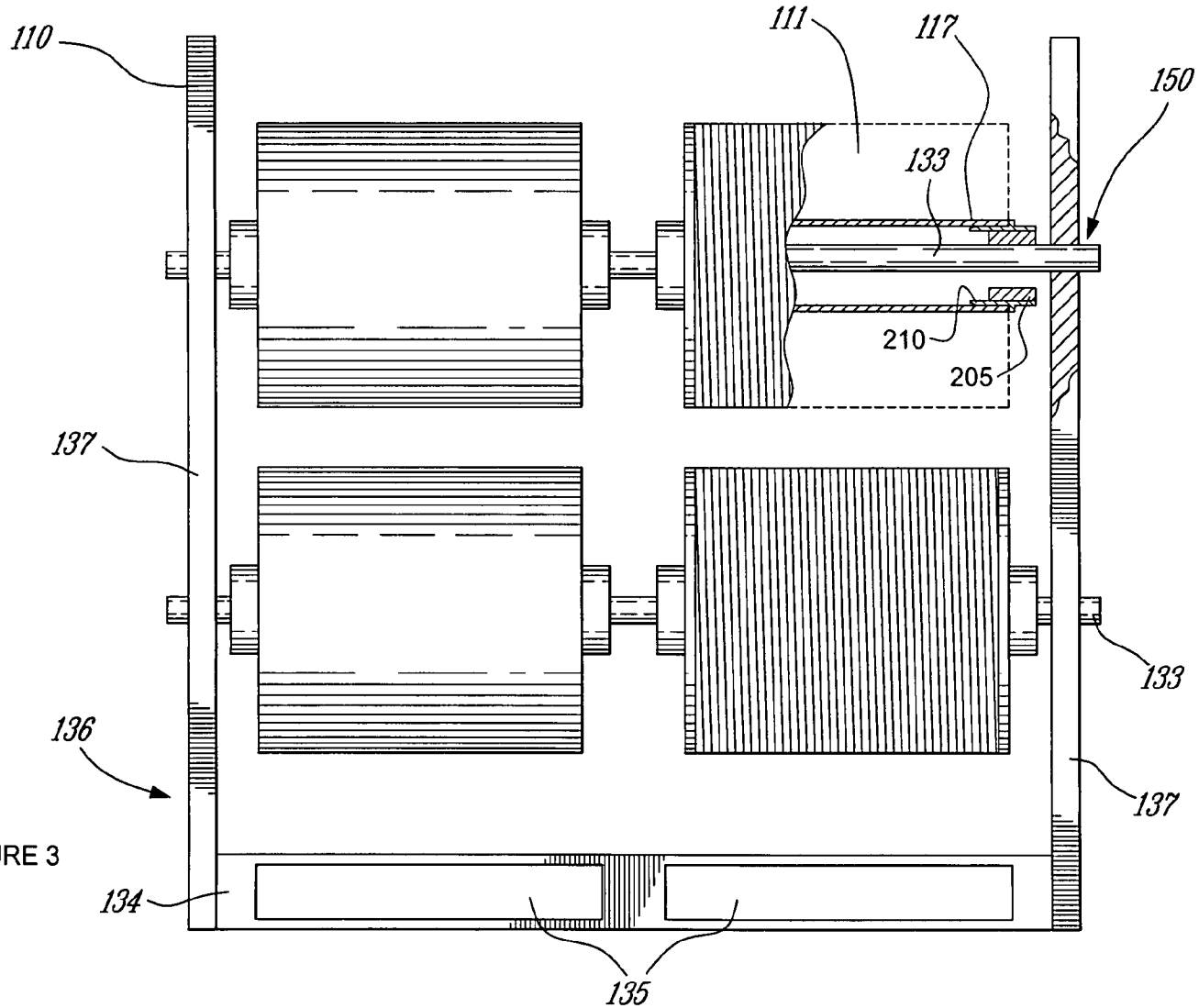
FIG. 3 is a front view of the tape dispenser assembly shown in FIG. 1 showing the shaft holder and the tensioning system.
Figure 4:
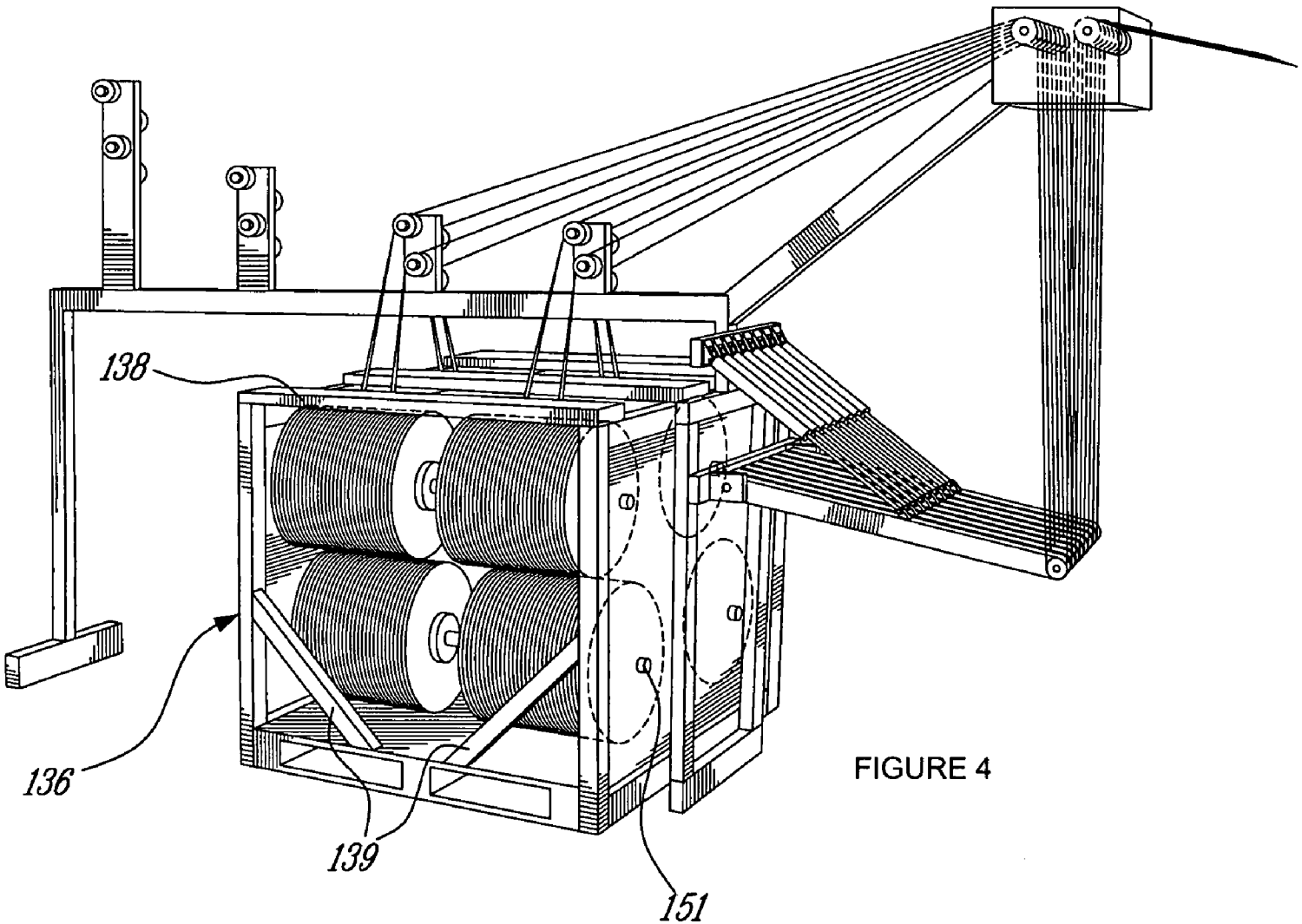
FIG. 4 is a perspective view of the tape dispenser assembly shown in FIG. 1 with the frame rack.

Referring now to FIGS. 3 and 4, the tape dispenser assembly 110 comprises a base 134. The base 134 is preferably a standard ISO (International Organization for Standardization) wooden pallet with openings 135 to be used by fork lift or pallet jack. A rolls support structure 136 is fixedly attached with screws, nails or the likes onto the base pallet 134. Support structure 136 comprises two opposing parallel walls 137.

Walls 137 preferably extend upwardly and perpendicularly from the base pallet. Walls 137 are linked together at their upper edges by reinforcing members 138. The reinforcing members 138 are parallel to the base pallet and are attached to the walls with screws, nails or the like. Angular reinforcing members 139 preferably link the sides of the walls 137 to the base pallet 134. The angular reinforcing members 139 are also attached with screws, nails or the like. The support structure 136 thus creates a box like shape. Located of the walls 137 are shaft holes 150. It is to be noted that each shaft hole 150 on a wall 137 has a correspondingly aligned shaft hole 150 in the opposing wall 137. Misalignment of two corresponding holes 150 would results in a misalignment of the shaft 133. The support structure 136 further comprises several parallel shafts 133 which are used to hold the tape rolls. The shafts 133 extend from one wall to the other and are slightly longer than the support structure 136. Preferably, the protruding ends of the shafts 133 are used to lock the shafts in place using the locking means 151. There are thus two upper shafts 133 and two lower shafts 133 in this embodiment. It is to be understood that the number of shafts may vary in different embodiments as well as the number of roll of tape supported by a shaft.

As shown, the annular portion 205 is in contact with the shaft 133 and the cylindrical body is in contact with the core 117. The annular portion 205 has an internal diameter that is larger than the external diameter of the shaft 133.

Figure 5:
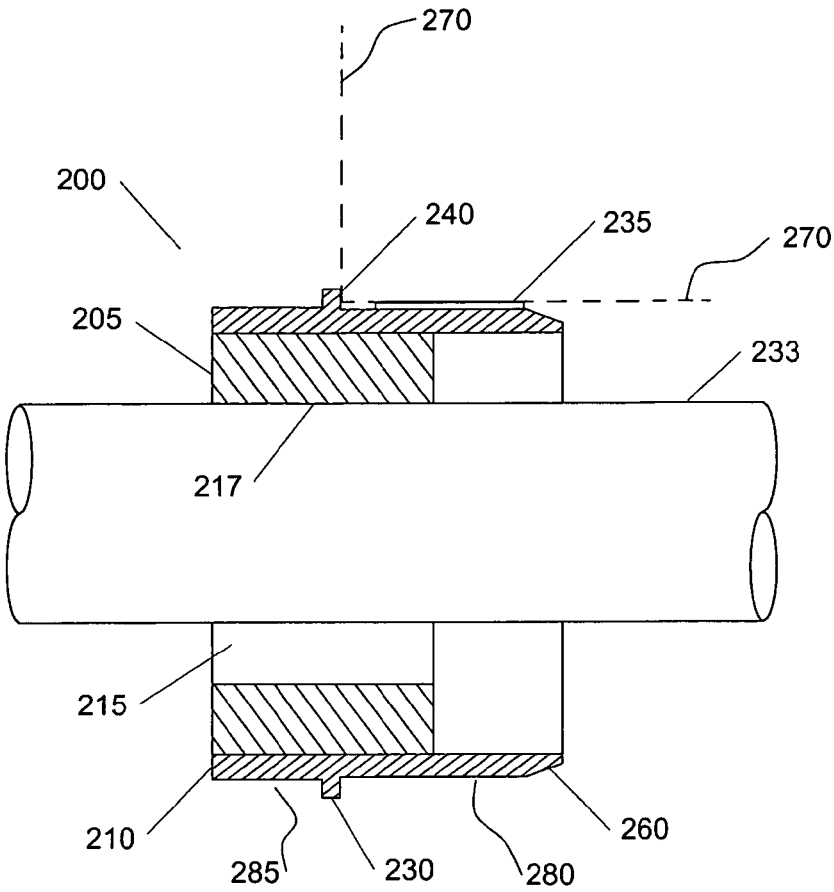
FIG. 5 is a crow-section side view of the roll holder of the present invention.
Figure 6:
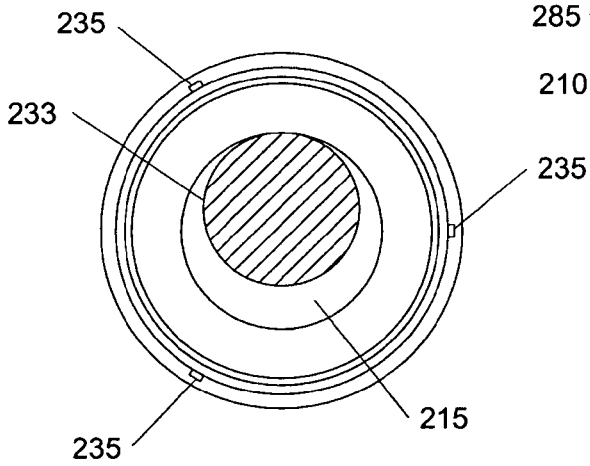
FIG. 6 is a cross-section side view of the roll holder shown in FIG. 5.
Figure 7:
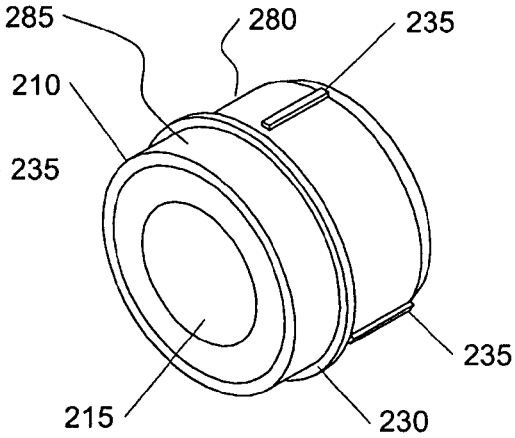
FIG. 7 is a perspective view of the roll holder.

FIG. 5 shows in more details the roll holder 200. The roll holder comprises a cylindrical hollow body 210 comprising a first portion 280 and a second portion 285, the first portion 280 being adapted to be received by the core 117 of the tape roll 111. The external surface of the cylindrical body 210 preferably comprises a circumferential extending rib such as a blind stop 230. The side of a tape roll (shown by phantom links 270) will abuts against the side 240 of the blind stop 230. It is to be noted that the blind stop may be composed by a plurality of parts and may have another shape than the one illustrated.

The extremity 260 of the cylindrical body 210 may be tapered to facilitate the insertion of the roll holder 200 into the core of the tape roll.

A plurality of tongues 235 are disposed on the external surface of the first portion 280 of the cylindrical body 210 so that the tape roll is press-fitted on the tongues 235 of the cylindrical body 210. The shaft 233 on which the tape rolls are disposed pass through the opening 215 and is in contact with the upward surface 217 of the annular portion 205.

The annular portion 205 may be made from bronze or other materials creating friction between the shaft and the annular portion in order to create a resistance against the rotation of the tape roll. Other materials for the annular portion may be, for example, brake lining or manganese. The amount of friction generated may thus adjusted by varying the material of the annular portion, and by varying the length of the annular portion. Indeed, the amount of friction generated is influenced by the contact surface and the particular friction coefficient of the material chosen.

The cylindrical body is typically made from metal, such as steel.

Figure 8:
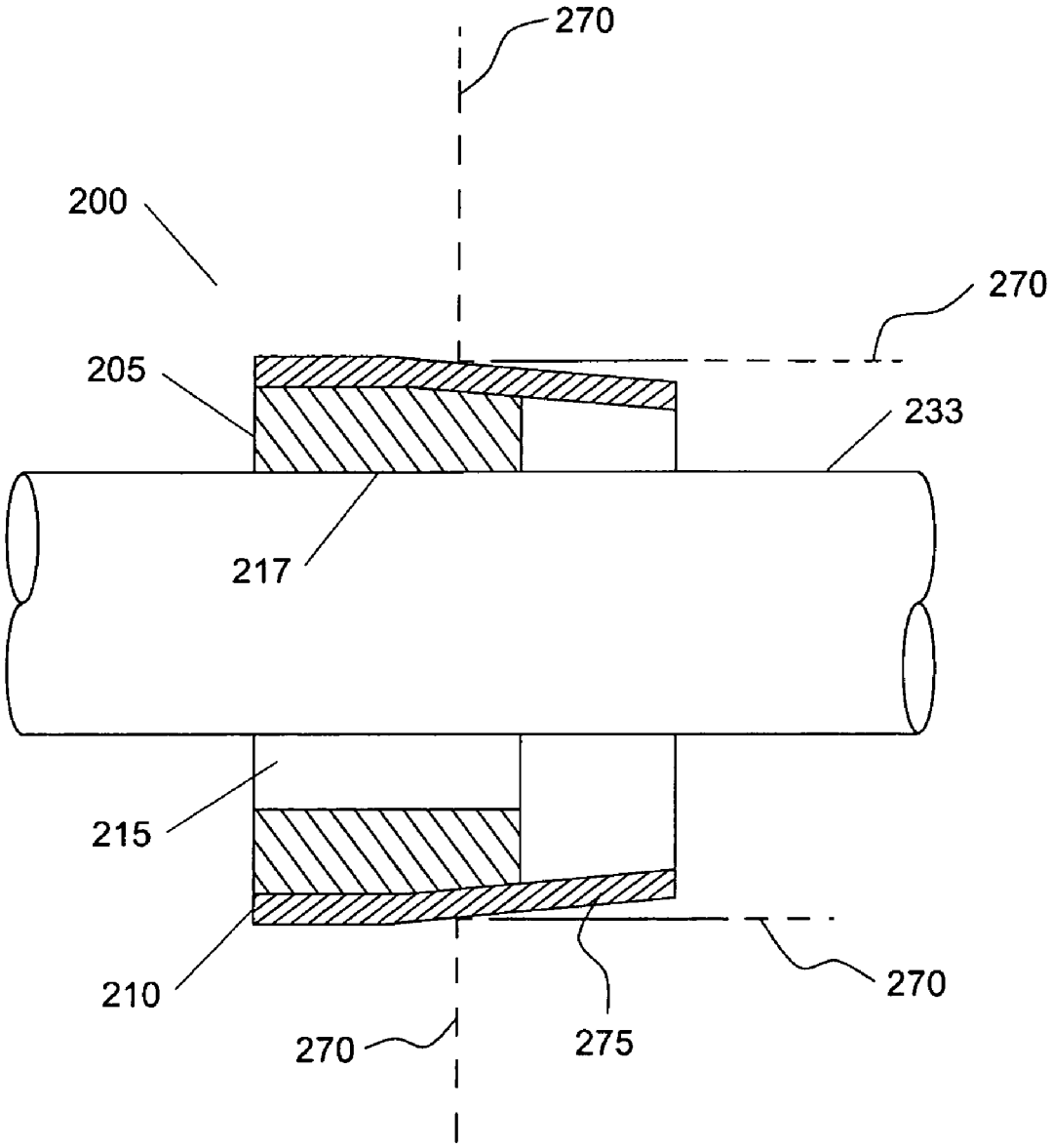
FIG. 8 is a cross-section side view of a further embodiment of the roll holder.

FIG. 8 illustrates a roll holder having a conical or tapered first portion 275. As shown, the side of a tape roll (shown by phantom links 270) will abuts against outer surface of the conical first portion 275.

It is to be noted that the roll holder may be adaptable to a core that has a shape that is not circular or cylindrical. Indeed, only the internal surface of the annular portion has to be circular to rotate on the shaft.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A roll holder for use in combination with a roll of tape or the like for the dispensing of said tape, said roll comprising a core on which said tape is wound, said core comprising an inner surface and two ends and being configured to be supported by a shaft, said shaft comprising an outer surface; and an outer diameter, said roll holder comprising:

a) a cylindrical hollow body configured for at least partial insertion into one of said ends of said core, and for frictional engagement with said inner surface of said core;

b) an annular portion located substantially inside said cylindrical body, said annular portion comprising an opening through which said shaft can extend, said opening comprising an inner diameter and an inner surface, said inner diameter being larger than said outer diameter of said shaft such that said roll holder can rotate about said shalt, said inner surface being configured for being in partial contact with said outer surface of said shaft such as to generate friction therewith when said tape is dispensed from said roll;

whereby said, friction generated between said inner surface of said annular portion and said outer surface of said shaft provides tension in said tape when said tape is dispensed from said roll.

2. The roll holder for tape dispensing of claim 1, wherein said annular portion is made from a material providing a predetermined amount of said friction between said inner surface of said annular portion and said outer surface of said shaft.

3. The roll holder for tape dispensing of claim 1, wherein said annular portion is made of bronze.

4. The roll holder for tape dispensing of claim 1, wherein said cylindrical body comprises a first portion and a second portion, and wherein said first portion and said second portion are separated by a blind stop.

5. The roll holder for tape dispensing of claim 4, wherein said blind stop is configured to abut on said one of said ends of said core when said first portion is inserted into said one of said ends of said core.

6. The roll holder for tape dispensing of claim 1, wherein said cylindrical body comprises a first portion and a second portion, and wherein said first portion is conical.

7. The roll holder for tape dispensing of claim 1, wherein said cylindrical body comprises a first portion and a second portion, wherein said first portion defines an outer surface, and wherein said outer surface of said first portion comprises a plurality of tongues extending substantially parallel to an axis of said roll holder.

8. The roll holder for tape dispensing of claim 1, wherein said cylindrical body comprises a circumferentially extending rib.

9. The roll holder for tape dispensing of claim 1, wherein said cylindrical body comprises a first portion and a second portion, wherein said first portion comprises a free extremity, and wherein said free extremity is tapered.

10. The roll holder for tape dispensing of claim 1, wherein said cylindrical body is made of steel.

11. A pair of roll holders in combination with a rolls of tape or the like, said roll comprising a core on which said tape is wound, said core comprising an inner surface and two ends and being configured to be supported by a shaft, said shaft comprising an outer surface and an outer diameter, each of said roll holders comprising:

a) a cylindrical hollow body at least partially inserted into one of said ends of core, and being frictionally engaged with said inner surface of said core;

b) an annular portion located substantially inside said cylindrical body, said annular portion comprising an opening through said shaft can extend, said opening comprising an inner diameter and an inner surface, said inner diameter being larger than said outer diameter of said shaft such that said roll holder can rotate about said shaft, said inner surface being configured for being in partial contact with said outer surface of said shaft such as to generate friction therewith when said tape is dispensed from said roll;

whereby said friction generated by said inner surfaces of said annular portions of said roll holders and said outer surface of said shaft provides tension in said tape when said tape is dispensed from said roll.

12. The combination of claim 11, wherein, for each of said roll holders, said annular portion is made from a material providing a predetermined amount of friction between said inner surface of said annular portion and said outer surface of said shaft.

13. The combination of claim 11, wherein, for each of said roll holders, said annular portion is made of bronze.

14. The combination of claim 11, wherein, for each of said roll holders, said cylindrical body comprises a first portion and a second portion, and wherein said first portion and said second portion are separated by a blind stop.

15. The combination of claim 14, wherein each of said blind stops abuts on a respective one of said ends of said core.

16. The combination of claim 11, wherein, for each of said roll holders, said cylindrical body comprises a first portion and a second portion, and wherein said first portion is conical.

17. The combination of claim 11, wherein, for each of said roll holders, said cylindrical body comprises a first portion and a second portion, wherein said first portion defines an outer surface, and wherein said outer surface of said first portion comprises a plurality of tongues extending preferably in parallel to the axis of said roll holder.

18. The combination of claim 11, wherein, for each of said roll holders, said cylindrical body comprises a circumferentially extending rib.

19. The combination of claim 11, wherein, for each of said roll holders, said cylindrical body comprises a first portion and a second portion, wherein said first portion comprises a free extremity, and wherein said free extremity is tapered.

20. The combination of claim 11, wherein, for each of said roll holders, said cylindrical body is made of steel.

21. A dispenser assembly comprising:

a) a frame;

b) a shaft mounted to said frame, said shaft comprising an outer surface and an outer diameter;

c) at least one roll of tape or the like mounted to said shaft, said roll comprising a core on which said tape is wound, said core comprising an inner surface and two ends;

d) at least one pair of roll holders mounted to said at least one roll, each of said roll holders comprising:

i) a cylindrical hollow body at least partially inserted in one of said ends of said core of said at least one roll, and being frictionally engaged with said inner surface of said core of said at least one roll;

ii) an annular portion located substantially inside said cylindrical body, said annular portion comprising an inner diameter and an inner surface, said inner diameter being larger than said outer diameter of said shaft such that said roll holder can rotate about said shaft, said inner surface being in partial contact with said outer surface of said shaft such as to generate friction therewith when said tape is dispensed from said at least one roll;

whereby said friction generated between said inner surfaces of said annular portions and said outer surface of said shaft provides tension in said tape when said tape is dispensed from said at least one roll.

22. The dispenser assembly of claim 21, wherein, for each of said roll holders, said annular portion is made from a material providing a predetermined amount of friction between said inner surface of said annular portion and said outer surface of said shaft.

23. The dispenser assembly of claim 21, wherein, for each of said roll holders, said annular portion is made of bronze.

24. The dispenser assembly of claim 21, wherein, for each of said roll holders, said cylindrical body comprises a first portion and a second portion, and wherein said first portion and said second portion are separated by a blind stop.

25. The dispenser assembly of claim 24, wherein each of said blind stops abuts on a respective one of said ends of said core of said at least one roll.

26. The dispenser assembly of claim 21, wherein, for each of said roll holders, said cylindrical body comprises a first portion and a second portion, and wherein said first portion is conical.

27. The dispenser assembly of claim 21, wherein, for each of said roll holders, said cylindrical body comprises a first portion and a second portion, wherein said first portion defines an outer surface, and wherein said outer surface of said first portion comprises a plurality of tongues extending preferably in parallel to the axis of said roll holder.

28. The dispenser assembly of claim 21, wherein, for each of said roll holders, said cylindrical body comprises a circumferentially extending rib.

29. The dispenser assembly of claim 21, wherein, for each of said roll holders, said cylindrical body comprises a first portion and a second portion, wherein said first portion comprises a free extremity, and wherein said free extremity of said first portion is tapered.

30. The dispenser assembly of claim 21, wherein for each said roll holders, said cylindrical body is made of steel.

* * * * *